US006073307A

United States Patent [19]

Santos et al.

[11] Patent Number: 6,073,307

[45] Date of Patent: Jun. 13, 2000

[54] HANDGRIP HAVING AN ADJUSTABLE LENGTH

[76] Inventors: James P. Santos; Peter J. Santos, both of 557 High Farms Rd., Stowe, Vt. 05672

[21] Appl. No.: 09/049,451

[22] Filed: Mar. 27, 1998

Related U.S. Application Data

[60] Provisional application No. 60/042,557, Mar. 31, 1997.

[51] Int. Cl.[7] ..... A63C 11/22

[52] U.S. Cl. ..... 16/115; 16/12 D

[58] Field of Search ..... 16/115, 12 D; 403/27, 320, 326; 116/230, 240

[56] References Cited

U.S. PATENT DOCUMENTS

| | | | |
|---|---|---|---|
| 904,673 | 11/1908 | Bideker | 403/320 |
| 951,836 | 3/1910 | Noack | 403/362 |
| 1,406,841 | 2/1922 | Fose | 16/115 |
| 3,436,090 | 4/1969 | Lange et al. | 280/11.37 |
| 3,722,903 | 3/1973 | Jones | 280/11.37 F |
| 3,879,048 | 4/1975 | Penney | 280/11.37 H |
| 3,992,021 | 11/1976 | Tobin | 280/11.37 H |
| 4,581,958 | 4/1986 | Shull | 81/177.2 |
| 4,645,235 | 2/1987 | Joseph | 16/DIG. 12 |
| 4,750,760 | 6/1988 | Gurley | 280/821 |

*Primary Examiner*—Anthony Knight
*Assistant Examiner*—Alison K. Pickard
*Attorney, Agent, or Firm*—Jeffrey E. Semprebon; Michael J. Weins

[57] ABSTRACT

A handgrip having an adjustable length having a handle terminating in a first end and a second end and a first restraining element attached to the first end of the handle and a second restraining element engaged with the second end of the handle, the second restraining element positioned a distance D from the first restraining element. Means are provided to change the distance D between the first restraining element and the second restraining element to adjust to different hand breadths and means are also provided to secure the second restraining element to the second end of the handle. A sleeve is preferably attached to the second restraining element and a detent can be provided between the second restraining element and the second end of the handle. Indicia can also be provided on the second end of the handle to indicate the setting of the adjustment means.

14 Claims, 3 Drawing Sheets

HANDGRIP HAVING AN ADJUSTABLE LENGTH

This Appln claims the benefit of U.S. Provisional No. 60/042,557, filed Mar. 31, 1997.

FIELD OF THE INVENTION

The invention relates to the field of handgrips for hand tools, power tools, ski poles, and other related instruments, and more particularly to a handgrip having an adjustable length.

BACKGROUND OF THE INVENTION

Tools which a user grips for support or operation are part of most people's every day recreational and work life. From ski poles to manual and power tool handgrips, all require maximum hand control for safety and performance.

NASA anthropometric measurements show that there are substantial variations in hand breadth within gender as well as between genders. In assuming grip positions, the power grasp is the grip used in applications such as holding a power drill, carrying a pipe, or grasping a ski pole where the thumb is generally in direct opposition to the fingers, and it is the maximum force that can be exerted by the hand. The oblique grasp is the grip used with tools such as wrenches, screwdrivers, and paint scrapers, and it can utilize only about 65 percent of the strength of the power grip. Both grip types demand different handgrip lengths consistent with hand breadth variations for maximum comfort and effectiveness. A continuous muscular stress greater than approximately 15% of the maximum stress of a muscle group results in early fatigue of that muscle group with attendant compromise of task effectiveness, increased musculoskeletal disorders, and accident rates. (W. Rohmert, Applied Ergonomics, Vol. 4, pages 91–95, 1973; Butterworth Scientific Ltd.) From skiers gripping ski poles to workers operating various types of hand and power tools, it is important for those users to maximize control while exerting minimal muscular effort and thereby reducing fatigue.

The upper bearing surface of the hand is the thumb and first digit or radial segment of the hand and the lower bearing surface of the hand is the outside edge or ulnar portion of the hand. When a hand grasps a handgrip, the palmar region normally presses against the handgrip body to control the implement or tool. There is often insufficient purchase depending on handgrip length and diameter, and inadequate support on the upper and lower bearing surfaces of the hand. Cradling the upper and lower bearing surfaces of the hand when gripping a handgrip substantially increases purchase and therefore increases control and safety while reducing the strength levels needed to successfully complete a task.

There have been several inventions that have focused on segmented handgrips that will, in effect, partially conform to a user's grip by adding spacers for grip diameter adjustment or by adding upper and/or lower projections or surfaces.

One example of a handgrip with a variable shape is U.S. Pat. No. 4,645,235 which describes a multi-element ski pole handgrip, one whose elements can be changed to offer different handgrip thicknesses. Other examples of designs to improve handgrip comfort and control are U.S. Pat. Nos. 4,750,760, 3,992,021, 3,879,048, and 3,436,090 which describe ski pole handgrips contoured with upper and lower support surfaces.

The aforementioned patents are restricted to a particular handgrip length which corresponds to a specific hand breadth. It is critical, however, for the hand to fit snugly with the handgrip because a smaller hand relative to a handgrip will allow unwanted hand movement relative to the handgrip, and a larger hand relative to a handgrip will compromise grip strength and comfort because of an incorrect fit. Both result in decreased task effectiveness and safety. Having the ability to adjust the cradling capability of a handgrip maximizes the contact surface area on the gripping hand and allows minimal movement of the hand relative to the handgrip. By applying this support, less effort is required on the part of the user to effect maximum control with substantially less fatigue. This functional differentiation will result in improved performance, comfort, and safety.

There is a need for the present invention because none of the aforementioned inventions address the problem of adjusting handgrips to the user's hand breadth.

OBJECTS OF THE INVENTION

The primary object of the invention is to provide a handgrip that increases grip control.

Another object of the invention is to provide a handgrip that can adjust to different hand breadths.

A further object of the invention is to provide a handgrip that is safe.

Still another object of the invention is to provide a handgrip that minimizes fatigue.

Another object of the invention is to provide a handgrip that is comfortable.

SUMMARY OF THE INVENTION

The present invention provides a handgrip having an adjustable length which has particular utility for use in hand tools, power tools, ski poles, and other related instruments having handgrips.

In an elementary form, the invention has a handle, which in turn has a first end and a second end. A first restraining element is provided which is attached to the first end of the handle. A second restraining element is also provided which is engaged with the second end of the handle and is spaced apart from the first restraining element. Adjustment means are provided to adjust the distance between the first restraining element and the second restraining element.

The first restraining element is a projection, tool body, hand guard, or any related protrusion from the handle that restricts either the upper or lower bearing surfaces of the hand when gripping. The second restraining element is also a projection or related protrusion which is adjustable along the length of the handle and also restricts either the upper or lower bearing surfaces of the hand when gripping. Taken together, the first and second restraining elements, in effect, cradle the user's grip by contacting both the upper and lower bearing surfaces of the hand. The adjustment of the distance between the first and second restraining elements is necessary to ensure sufficient contact with both surfaces of the hand.

It is preferred that means be provided to lockably secure the second restraining element to the second end of the handle.

In one preferred embodiment, the means for adjusting the distance between the first restraining element and the second restraining element is accomplished by the second restraining element being frictionally engaged with the second end of the handle.

It is further preferred that a sleeve is provided which is attached to the second restraining element and that the sleeve is preferably tapered and preferably made of an elastically compliant material which serves to secure the second restraining element to the second end of the handle when gripped.

In another preferred embodiment, the means for adjusting the distance between the first restraining element and the second restraining element is accomplished by the second restraining element being threadably engaged with the second end of the handle.

It is further preferred that a detent is provided between the second restraining element and the second end of the handle. It is still further preferred that indicia are provided to indicate the setting of the adjustment means. It is further preferred that a set screw is provided to lockably secure the second restraining element to the second end of the handle.

In still another preferred embodiment, the second restraining element is threadably engaged to the second end of the handle and is secured thereto by frictional means. It is further preferred that the second restraining element is essentially concave in configuration to the first restraining element.

In another preferred embodiment, the means for adjusting the distance between the first restraining element and the second restraining element is accomplished by the second restraining element being slideably engaged with the second end of the handle.

It is further preferred that a spring-loaded button is provided on the second end of the handle which mates with selected orifices in the second restraining element to lockably secure the second restraining element to the second end of the handle.

In still another preferred embodiment, the means for adjusting the distance between the first restraining element and the second restraining element is accomplished by the second restraining element being both slideably and rotatably engaged with the second end of the handle.

It is further preferred that a passage is provided in the second restraining element which serves as a passage to the handle. It is still further preferred that the handle is a handle to a power tool and that the first restraining element is preferably the body of the power tool.

DESCRIPTION OF THE PREFERRED EMBODIMENTS

Figure 1:
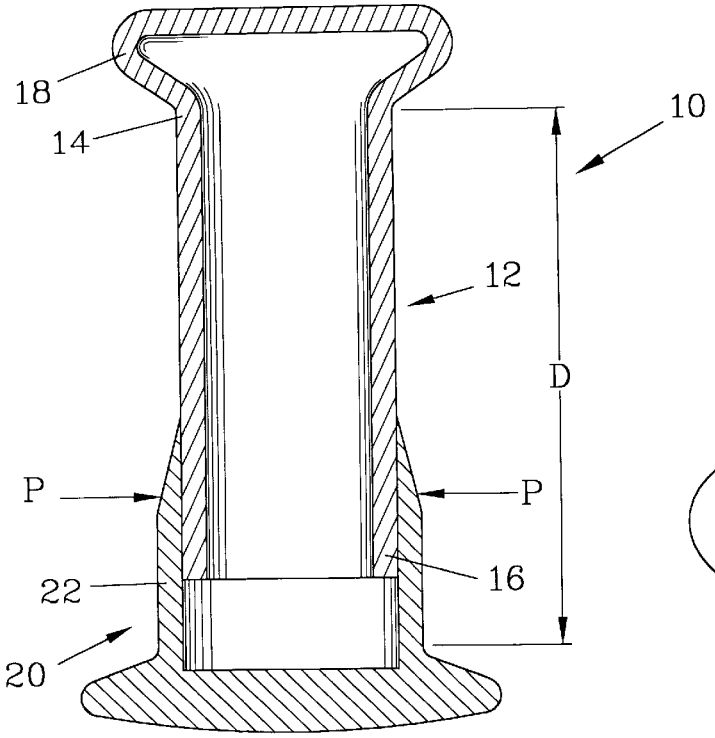
FIG. 1 is a cross section view of one embodiment of the invention, showing the second restraining element frictionally engaged with the second end of the handle and showing the sleeve attached to the second restraining element.

FIG. 1 shows the device 10 having a handle 12 which has a first end 14 and a second end 16. A first restraining element 18 is attached to the first end 14 of the handle 12 and restricts the upper bearing surface of the hand when gripping the handle 12. A second restraining element 20 is frictionally engaged with the second end 16 of the handle 12. A sleeve 22, made of an elastically compliant material, is attached to the second restraining element 20 and encircles the second end 16 of the handle 12 and a portion of the handle 12. The sleeve 22 is tapered to provide a smooth transition when gripping the handle 12. When pressure P is put around the handle 12 as the handle 12 is gripped, the sleeve 22 elastically complies with the user's hand and the handle 12, with the user's hand providing pressure P through the sleeve 22 to the handle 12, thereby creating increased friction between the sleeve 22 and the handle 12. This additional friction secures the second restraining element 20 to the second end 16 of the handle 12. The second restraining element 20 thereby restricts the lower bearing surface of the hand when gripping the handle 12. When the handle 12 is not gripped, the second restraining element 20 can be moved relative to the second end 16 of the handle 12 by overcoming the frictional resistance, thereby changing the distance D between the first restraining element 18 and the second restraining element 20. This change in distance D allows for users with different hand breadths to adjust the device 10 for optimal use. It is understood that when a user grips the handle 12, he or she also partially grips the first end 14 of the handle 12 and the second end 16 of the handle 12. It is also understood that both the first restraining element 18 and the second restraining element 20 can fully or at least partially support the upper and lower bearing surfaces of the hand.

The critical element of support to the gripping hand is to maximize purchase area between the hand and a handgrip. This effects maximum control with substantially less fatigue and results in improved performance and safety. Cradling the upper and lower bearing surfaces of the hand when the hand is gripping a handgrip maximizes the surface area of contact and allows minimal movement of the hand relative to the handgrip. The ability to change the distance D of device 10 is important because it allows the user to adjust the device 10 to his or her optimal grip for maximum comfort, safety, and effectiveness.

Anthropometric data accumulated by NASA on men and women in the U.S. Military as well as in industry are one of the guidelines used in determining the relative range of grip breadths.

HAND BREADTH DATA (Adapted from NASA, 1978)

| HAND BREADTH DATA (Adapted from NASA, 1978) | | | |
|---|---|---|---|
| | 50th percentile ± 1 Standard Deviation | | |
| | Males | | Females |
| Hand Breadth (inches) | 3.4 ± 0.2 | | 3.0 ± 0.2 |
| Population Percentiles | 5th | 50th | 95th |
| 50% Males, 50% Females | 2.8 | 3.2 | 3.6 |

For both men and women, a hand breadth range on a handgrip that accommodates the majority of the population (between the 5th and 95th percentiles) is 2.8 to 3.6 inches. However, since many tools, ski poles, or other similar handgrips are used with light or heavy gloves, as well as with bare hands, handgrip length and attendant support range adjustments will have to be made to optimize comfort, safety, and control under varying conditions and usage.

Figure 2:
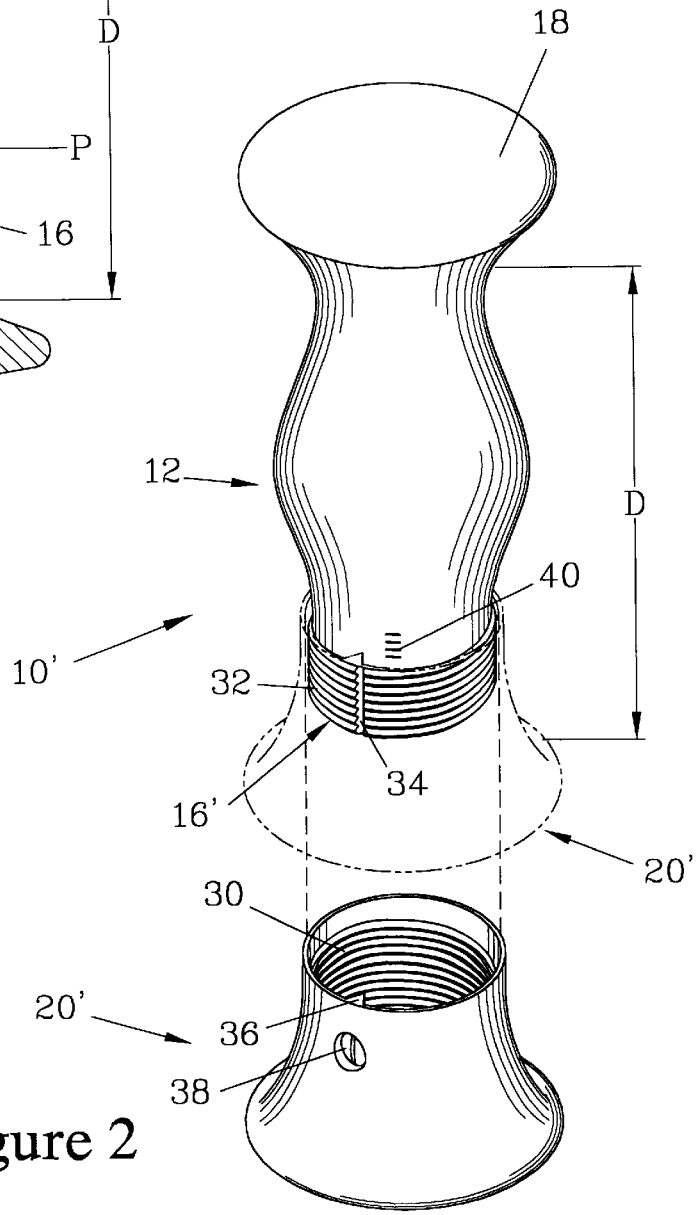
FIG. 2 is an exploded view of another embodiment of the invention, showing the second restraining element threadably engaged with the second end of the handle and showing the detent between the second restraining element and the second end of the handle, the indicia on the second end of the handle, and the set screw on the second restraining element.

FIG. 2 shows the device 10' with a second restraining element 20' containing female screw threads 30 which are threadably engaged to male screw threads 32 on the second end 16' of the handle 12. When the second restraining element 20' is rotated about the second end 16' of the handle 12, the distance D between the first restraining element 18 and the second restraining element 20' (in phantom) changes. It is understood that the device 10' can be made having a frictional component between the second restraining element 20' and the second end 16' of the handle 12 to reduce the possibility of unwanted relative movement which would change the distance D between the first restraining element 18 and the second restraining element 20' (in phantom). Since most of the possible forces on the elements of device 10' would not cause the second restraining element 20' to move relative to the second end 16' of the handle 12, only moderate friction is required to prevent the unwanted movement and to secure the second restraining element 20' to the second end 16' of the handle 12.

Also shown in FIG. 2 is a groove 34 in the second end 16 of the handle 12, axially positioned through male screw threads 32, and a projection 36 protruding from female screw threads 30. Together, the groove 34 and the projection 36 comprise a detent when they align as the second restraining element 20' is rotated about the handle 12. This detent acts as a signal so the user is aware of the number of rotations performed and of the relative position of the second restraining element 20' to the handle 12.

A set screw 38 is positioned in the second restraining element 20' so that it can align with and seat in the groove 34 in the second end 16' of the handle 12 when the second restraining element 20' is in the appropriate position relative to the groove 34. Together, the set screw 38 and the groove 34 lockably secure the second restraining element 20' relative to the second end 16' of the handle 12 to prevent any change of distance D.

Indicia 40 are also shown on the handle 12 and indicate the relative position of the second restraining element 20' and the distance D between the first restraining element 18 and the second restraining element 20' (in phantom). The indicia 40 are helpful when there are multiple users of a particular hand grip having differing hand breadths or when the handgrip is used with different thickness gloves.

Figure 3:
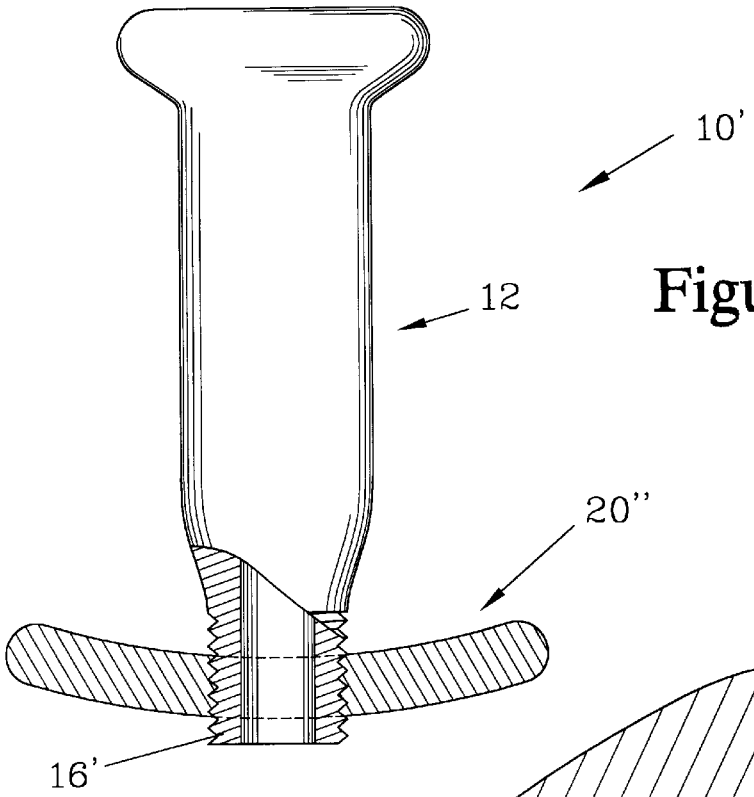
FIG. 3 is a partial cross section view of still another embodiment of the invention, showing the essentially concave second restraining element which is threadably engaged with the second end of the handle.

FIG. 3 shows the device 10' having a second restraining element 20" that threadably engages with the second end 16' of the handle 12. In this figure, the second restraining element 20" adjusts as in FIG. 2 and is an essentially concave disk. The concavity of the second restraining element 20" is beneficial because it provides greater surface area contact with the lower bearing surface of the hand by cupping the hand which results in greater control.

Figure 4:
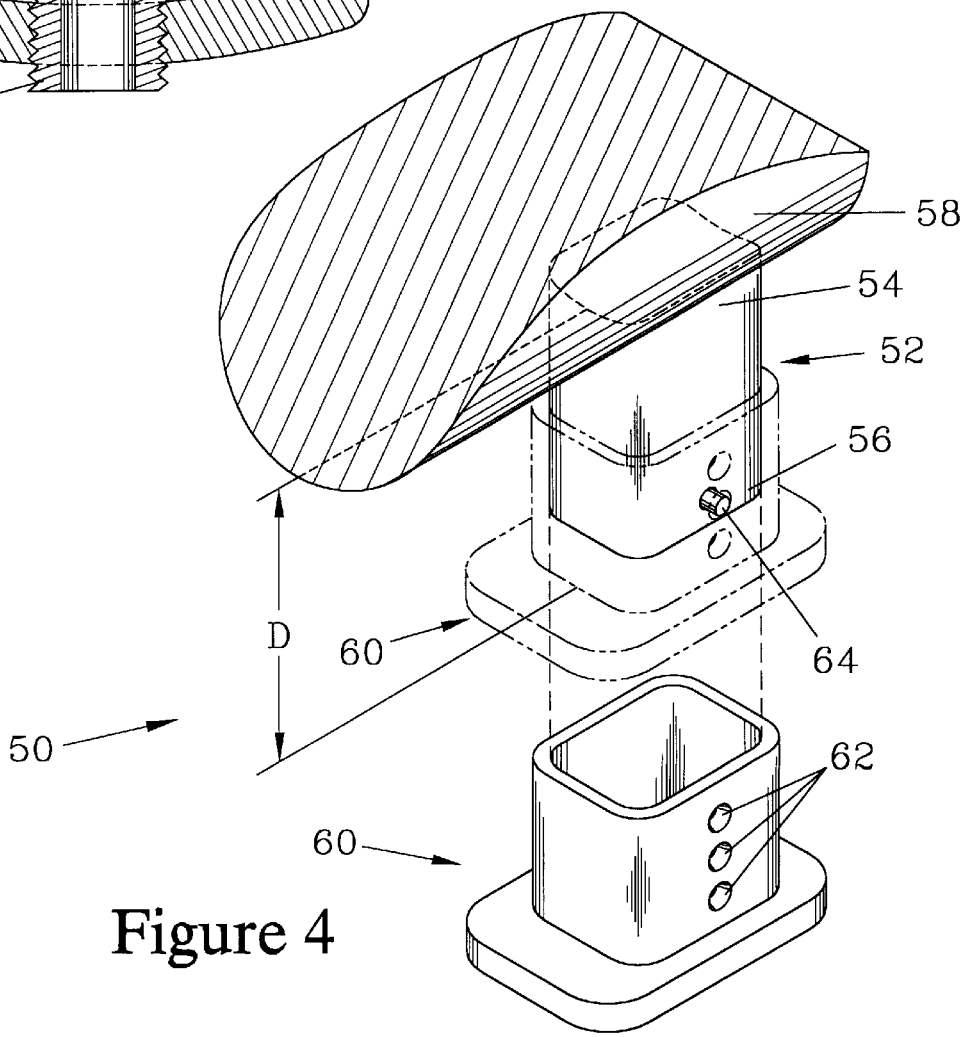
FIG. 4 is an exploded view of yet another embodiment of the invention, showing the second restraining element slideably engaged with the second end of the handle and showing the spring-loaded button on the second end of the handle mating with selected orifices on the second restraining element.

FIG. 4 shows the device 50, with an essentially non-round configured handle 52 with a first end 54 and a second end 56. The first restraining element 58, which is attached to the first end 54 of the handle 52, is the bottom surface of a housing. The second restraining element 60 slideably engages the second end 56 of the handle 52 and houses a series of orifices 62. A spring-loaded button 64, attached to the second end 56 of the handle 52, aligns with the series of orifices 62 so that as the second restraining element 60 slides along the second end 56 of the handle 52, the spring-loaded button 64 springably mates with one of the orifices 62, thereby lockably securing the second restraining element 60 to the second end 56 of the handle 52. To change the distance D between the first restraining element 58 and the second restraining element 60 (in phantom), the user presses the spring-loaded button 64 to unmate the spring-loaded button 64 and the selected orifice 62, and slides the second restraining element 60 along the second end 56 of the handle 52 until the spring-loaded button 64 mates with another selected orifice 62. The series of orifices 62 also serve as indicia indicating the relative position of the second restraining element 60 and the distance D between the first restraining element 58 and the second restraining element 60 (in phantom). The spring-loaded button 64 springably mated with the selected orifice 62 visibly indicates the selected setting.

Figure 5:
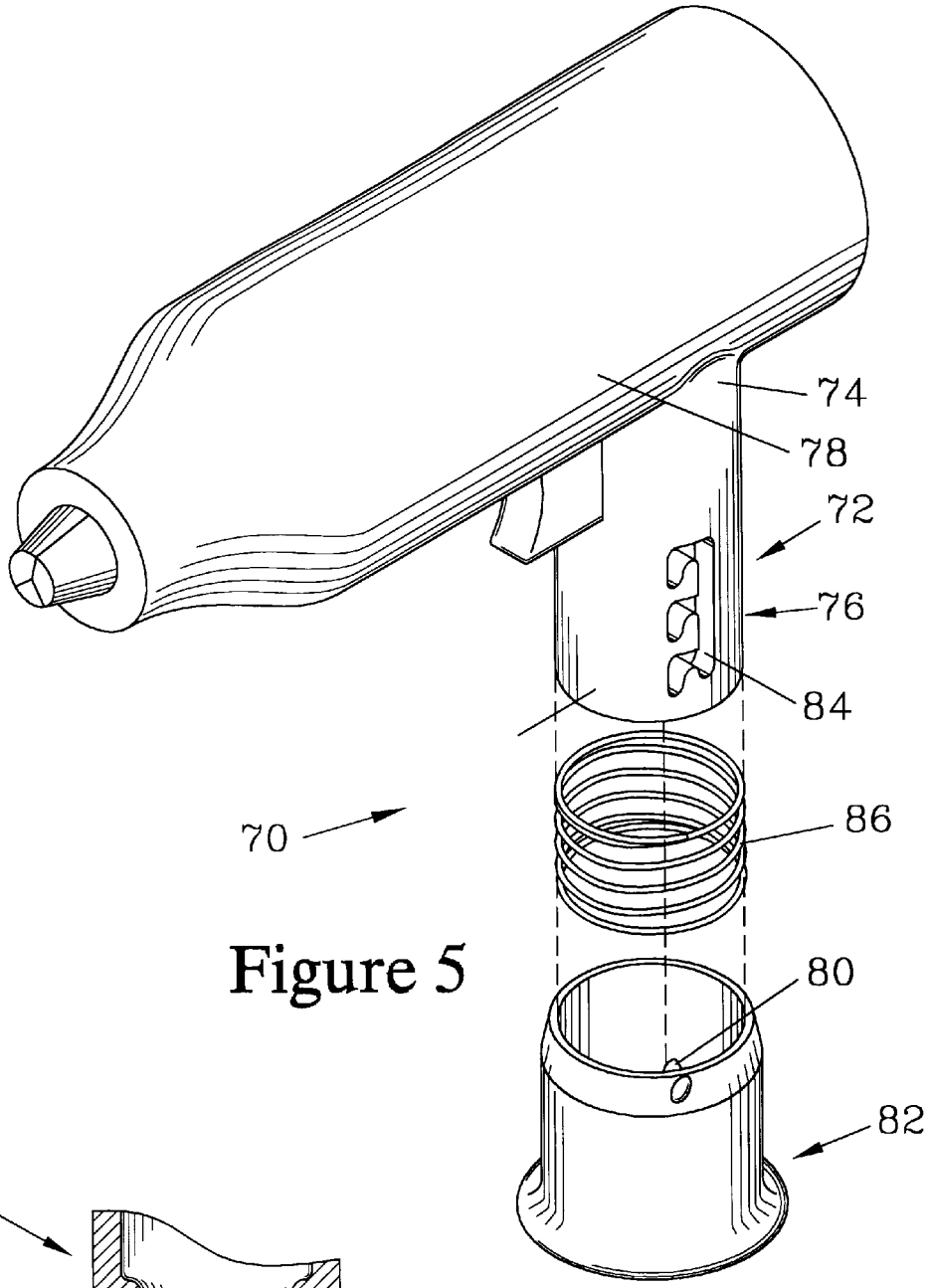
FIG. 5 is an exploded view of another embodiment of the invention, showing a power tool with the invention integral thereto. The second restraining element is shown slideably and rotatably engaged with the second end of the handle.

FIG. 5 shows the device 70, being the handgrip of a power tool, with an essentially round configured handle 72 with a first end 74 and a second end 76. The first restraining element 78 which is attached to the first end 74 of the handle 72 is the bottom surface of the motor housing of the power tool. A pin 80 attached to the second restraining element 82 slideably and rotatably engages a configuration of connected channels 84 housed in the second end 76 of the handle 72. A spring 86 is provided between the second restraining element 82 and the second end 76 of the handle 72 and provides a reaction force as the second restraining element 82 is moved closer to the first restraining element 78. The connected channels 84 housed in the second end 76 of the handle 72 are configured to allow the second restraining element 82 to slide directly towards the first restraining element 78, thus reducing the distance between the first restraining element 78 and the second restraining element 82, and then to allow the second restraining element 82 to partially rotate around the second end 76 of the handle 72, and then to allow the second restraining element 82 to slide nominally away from the first restraining element 78. The pin 80 attached to the second restraining element 82 stays within the connected channels 84 and allows only the aforementioned movements, as well as those movements in the reverse order. The spring 86 provides enough force so that when the pin 80 reaches the end of a connected channel 84 after rotation, the spring 86 forces the pin 80 into the end of a connected channel 84, thereby lockably securing the second restraining element 82 to the second end 76 of the handle 72. When the device 70 is set to a particular hand breadth, the lower bearing surface of the hand provides pressure against the second restraining element 82, further securing the second restraining element 82. It is understood that the lower bearing surface of the hand provides sufficient pressure on the pin 80 in the connected channel 84 to obviate the use of the spring 86.

Figure 5A:
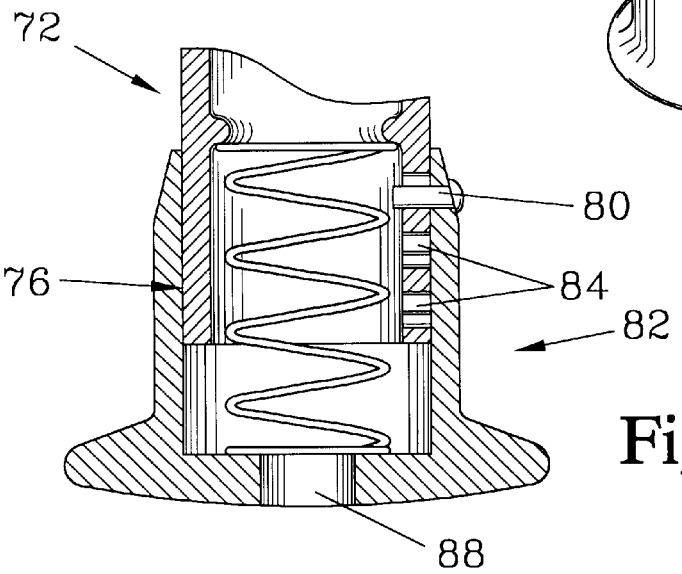
FIG. 5A is a cross section view of a portion of the embodiment in FIG. 5, showing the second restraining element slideably and rotatably engaged with the second end of the handle and showing a passage through the second restraining element to the handle.

FIG. 5A shows a partial cross section of device 70 from FIG. 5 with components assembled. The second restraining element 82 is lockably secured to the second end 76 of the handle 72 by the compression force of the spring 86 between the second restraining element 82 and the second end 76 of the handle 72 which puts force on the pin 80 into connected channel 84.

Also shown in FIG. 5A is a passage 88 essentially axially positioned through the second restraining element 82 which allows the passage of electrical or pneumatic lines into the handle 72.

While the novel features of the present invention have been described in terms of particular embodiments and preferred applications, it should be appreciated by one skilled in the art that substitution of materials and modification of details obviously can be made without departing from the spirit of the invention.

What we claim is:

1. A handgrip having an adjustable length comprising:

a handle terminating in a first end and a second end;

a first restraining element attached to said first end of said handle;

a second restraining element slidably engaged with said second end of said handle, said second restraining element being spaced apart from said first restraining element;

a spring-loaded button attached to said second end of said handle;

a series of orifices on said second restraining element, said series of orifices each being positioned to selectively springably mate with said spring-loaded button to lockably secure said second restraining element with said second end of said handle, each of said orifices being configured to allow a user to press said spring-loaded button when mated therewith so as to unmate said spring-loaded button therefrom.

2. The handgrip having an adjustable length of claim 1 wherein said second restraining element further comprises:

a sleeve attached to said second restraining element, said sleeve encircling said second end of said handle, said series of orifices being provided on said sleeve.

3. The handgrip having an adjustable length of claim 1 wherein said handle is attached to a power tool having a housing, further wherein a bottom surface of said housing serves as said first restraining element.

4. The handgrip having an adjustable length of claim 1 wherein said second restraining element is essentially concave in configuration to said first restraining element.

5. A handgrip having an adjustable length comprising:

a handle terminating in a first end and a second end;

a first restraining element attached to said first end of said handle;

a second restraining element slidably and rotatably engaged with said second end of said handle, said second restraining element being spaced apart from said first restraining element;

a pin attached to one of said second restraining element and said second end of said handle; and a configuration of connected channels on the other of said second restraining element and said second end of said handle, said pin movably engaging said configuration of connected channels to allow said second restraining element to move along said second end of said handle and to partially rotate around said second end of said handle.

6. The handgrip having an adjustable length of claim 5 further comprising:

a tapered sleeve attached to said second restraining element and encircling said second end of said handle, said pin being provided on said tapered sleeve and said configuration of connected channels being provided on said second end of said handle.

7. The handgrip having an adjustable length of claim 5 further comprising:

a compression spring forcibly engaging said second restraining element and said second end of said handle.

8. The handgrip having an adjustable length of claim 5 wherein said handle is attached to a power tool having a housing, further wherein a bottom surface of said housing serves as said first restraining element.

9. The handgrip having an adjustable length of claim 5 wherein said second restraining element is essentially concave in configuration to said first restraining element.

10. A handgrip having an adjustable length comprising:

a handle terminating in a first end and a second end;

a first restraining element attached to said first end of said handle;

a second restraining element movably engaged with said second end of said handle, said second restraining element being spaced apart from said first restraining element;

female screw threads provided on said second restraining element; and male screw threads provided on said second end of said handle and configured to threadably engage said female screw threads so as to provide means for means for adjusting the distance between said first restraining element and said second restraining element and means for securing said second restraining element with said second end of said handle.

11. The handgrip having an adjustable length of claim 10 wherein said means for securing said second restraining element with said second end of said handle further comprises:

frictional engagement between said male screw threads on said second end of said handle and said female screw threads on said second restraining element.

12. The handgrip having an adjustable length of claim 10 further comprising:

a groove axially positioned through one of said male threads and said female threads; and a projection protruding from the other of said male threads and said female threads, said projection engaging said groove to provide a detent between said second end of said handle and said second restraining element.

13. The handgrip having an adjustable length of claim 10 wherein said second restraining element is essentially concave in configuration to said first restraining element.

14. The handgrip having an adjustable length of claim 10 wherein said handle is attached to a power tool having a housing, further wherein a bottom surface of said housing serves as said first restraining element.

* * * * *